US006386725B1

(12) United States Patent
Amburgey

(10) Patent No.: US 6,386,725 B1
(45) Date of Patent: May 14, 2002

(54) SURFACE MOUNTED NIGHT LIGHT AND SOCKET ASSEMBLY

(76) Inventor: James D. Amburgey, 250 Mill St., P.O. Box 268, Pinckney, MI (US) 48169-0268

( * ) Notice: Subject to any disclaimer, the term of this patent is extended or adjusted under 35 U.S.C. 154(b) by 0 days.

(21) Appl. No.: 09/697,551

(22) Filed: Oct. 26, 2000

Related U.S. Application Data

(60) Provisional application No. 60/162,073, filed on Oct. 28, 1999.

(51) Int. Cl.[7] ..... F21V 33/00

(52) U.S. Cl. ..... 362/95; 362/802; 362/322; 200/310; 200/317

(58) Field of Search ..... 362/95, 226, 322, 362/373, 802; 200/310, 317, 50.02

(56) References Cited

U.S. PATENT DOCUMENTS 5,544,025 A * 8/1996 Bohlool et al. ..... 362/95
6,024,465 A * 2/2000 Kobayashi ..... 362/263
6,045,232 A * 4/2000 Buckmaster ..... 362/20
6,129,446 A * 10/2000 Hornung ..... 362/394

* cited by examiner

*Primary Examiner*—Stephen Husar
*Assistant Examiner*—Guiyoung Lee
(74) *Attorney, Agent, or Firm*—James M. Deimen

(57) ABSTRACT

A new night light comprises a night light as a permanent part of a face plate assembly that fits on a standard electrical box for a double socket or light switch. The face plate has assembled to it a small light bulb socket for a low wattage bulb, an on-off switch and a standard three prong socket in the preferred embodiments. The wiring for the components is all pre-assembled thereby permitting the new night light to be installed by connecting the ground and hot leads to the respective three wires extending into the standard electrical box. A suitable shade to diminish glare and direct light extends from the face plate, as does the on-off switch.

7 Claims, 1 Drawing Sheet

SURFACE MOUNTED NIGHT LIGHT AND SOCKET ASSEMBLY

This application claims the benefit of provisional patent application No. 60/162,073, filed Oct. 28, 1999.

BACKGROUND OF THE INVENTION

The field of the invention pertains to electric lighting and, in particular, to small lights usually used to provide a dim low light in residential rooms such as bedrooms, bathrooms and hallways at night. Such lights are intended to provide sufficient light for a sleepy person to walk around the room without colliding with furniture or walk from room to room without striking walls or tripping and falling. The light, however, is normally shaded and of low wattage to minimize any disturbance to sleeping persons.

A wide variety of plug-in night lights have been available for many years for residential use. The devices are typically equipped with integral plugs to simply fit into standard wall sockets. While satisfactory for residential use, plug-in night lights are not satisfactory for commercial use such as in hotels, motels, cruise ships and other locations where sleeping space is temporarily rented to strangers for relatively short periods of time. The collision and tripping hazards are much greater with persons unfamiliar with their surroundings.

Further, in commercial settings plug-in night lights are subject to easy loss or theft and can be the source of a tripping hazard themselves. In view of the inadequacy of plug-in night lights, the applicant has developed the surface mounted night light disclosed below.

SUMMARY OF THE INVENTION

The new night light comprises a night light as a permanent part of a face plate assembly that fits on a standard electrical box for a double socket or light switch. The face plate has assembled to it a small light bulb socket for a low wattage bulb, an on-off switch and a standard three-prong socket in the preferred embodiments. The wiring for the components is all preassembled thereby permitting the new night light to be installed by connecting the ground and hot leads to the respective three wires extending into the standard electrical box. A suitable shade to diminish glare and direct the light extends from the face plate as does the on-off switch.

DESCRIPTION OF THE PREFERRED EMBODIMENT

Figure 1:
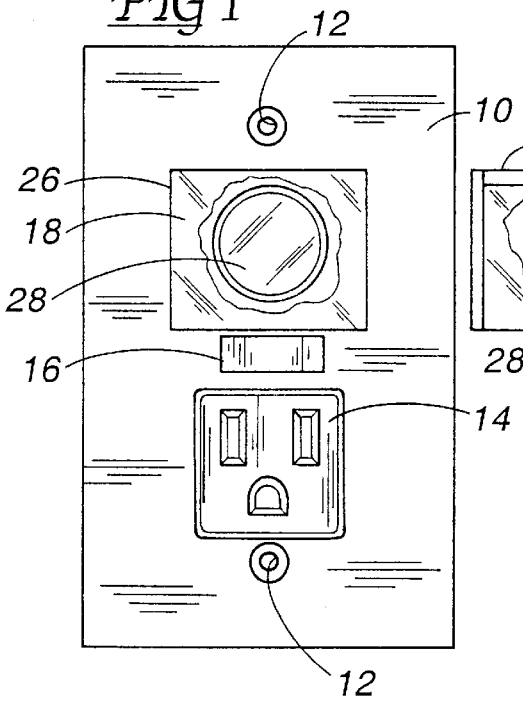
FIG. 1 is a front (face plate) view of the new light with a portion of the shade broken away.

In FIG. 1 an electrical box face plate 10 is shown having holes 12 for screws to fasten the face plate to a typical electrical box for a dual socket. The face plate 10 supports a three-prong socket 14, an on-off switch 16 and a small lamp assembly 18, all of which fit through holes in the face plate.

Figure 2:
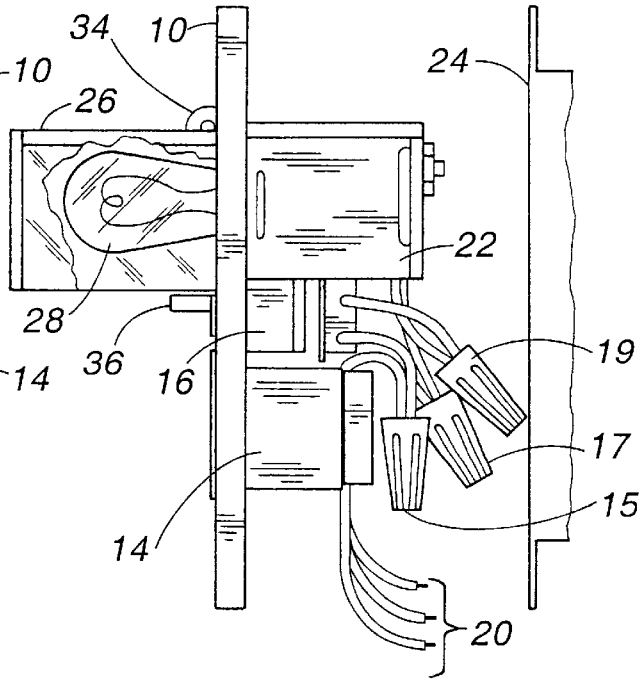
FIG. 2 is a right side view of the new light with a portion of the shade broken away.

As shown in FIG. 2, two "hot" electrical wires and a ground wire 20 enter the socket 14. One hot wire or lead 15 connects to the switch 16 and another hot lead 17 connects to the lamp socket 22 of the lamp assembly 18. The switch 16 is further connected with a hot lead 19 to the lamp socket 22. Thus, operation of the switch 16 controls the lamp light.

The entire electrical assembly above described behind the face plate 10 fits within a standard electrical box 24. The lamp assembly 18 includes a translucent or opaque shade 26 and low wattage bulb 28 to create a dim but adequate amount of light when installed in an electrical box 24 near the floor. The lamp shade 26 may be formed with vents 30 as best shown in FIG. 3 to prevent overheating of the shade despite the low wattage of the bulb 28.

The switch 16 is located under the lamp assembly 18 purposely to require the switch be operated manually and prevent operation by foot. Since the night light is intended to be located near the floor, foot operation would likely be attempted by patrons in a hotel or motel setting. Thus, if the switch were located above or to the side of the light assembly 18, patrons would more than likely attempt to operate the switch by foot. A misplaced attempt would then result in damage to the shade 26 and bulb 28.

As an alternative, a shade mounted to the face plate on a horizontal pivot at 34 in FIG. 2 combined with a push button switch at 16, both of substantial construction, could operate the light with foot actuation. Such a night light would also require a horizontal cross-bar 36 on the shade 26 to actuate the switch and would result in substantially increased manufacturing cost.

Figure 3:
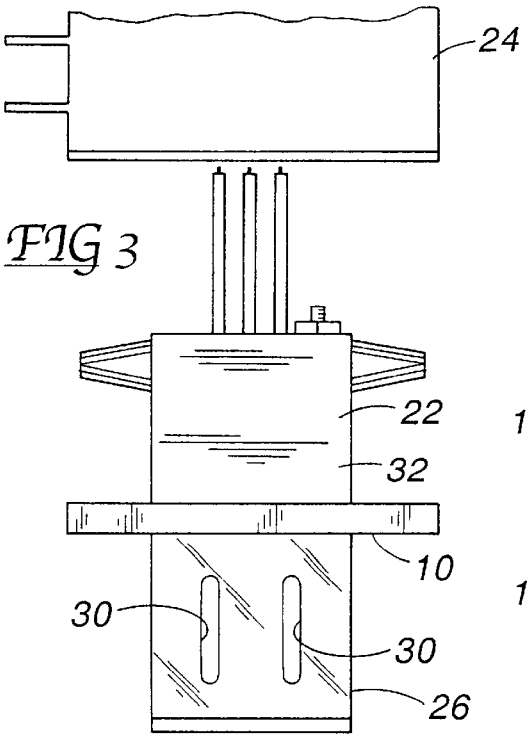
FIG. 3 is a top view of the new light.
Figure 4:
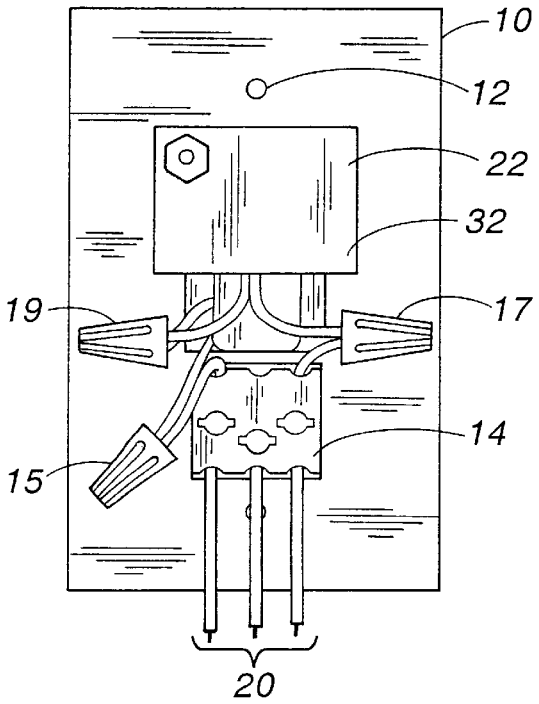
FIG. 4 is a back view of the new light.

Referring to FIGS. 3 and 4, the lamp socket 22 as shown includes a protective box 32. As an alternative, the protective box may be enlarged to include the portion of the switch 16 behind the face plate 10 and the portion of the prong socket 14 behind the face plate. Thus, the entire assembly behind the face plate 10 may be protected during shipment and installation of the night light.

While generally intended for installation near the floor in motel and hotel rooms, the new night light may be mounted at counter height in a bathroom with inclusion of a ground fault interrupter circuit. Here again, the switch 16 is preferably located under the bulb 28 and shade 26 to discourage operation with an elbow, and the switch is non-red to avoid confusion with the ground fault interrupter switch or circuit breaker.

What is claimed is:

1. An integral night light assembly comprises an electrical box face plate, a lamp socket mounted on the face plate and extending behind the face plate, a bulb in the socket, said bulb extending in front of the socket and face plate, an on-off switch mounted on the face plate below the bulb and electrically connected to the lamp socket, a shade mounted above the bulb, a horizontal pivot extending in front of the face plate and attaching the shade to the face plate, and means on the shade to actuate the on-off switch upon rotational movement of the shade about the horizontal pivot.

2. The integral night light assembly of claim 1 including a three prong socket mounted on the face plate, said three prong socket electrically connected to the switch and lamp socket.

3. The integral night light assembly of claim 1 including vents in the shade.

4. The integral night light assembly of claim 1 wherein the means on the shade to actuate the on-off switch comprise a cross-bar in front of the face plate and on the shade.

5. The integral night light assembly of claim 4 including a three prong socket mounted on the face plate, said three prong socket electrically connected to the switch and lamp socket and including vents in the shade.

6. An integral night light assembly comprises an electrical box face plate, a lamp socket mounted on the face plate, a bulb in the socket, said bulb extending in front of the socket and face plate, an on-off switch mounted on the face plate below the bulb and electrically connected to the lamp socket, a shade rotationally mounted on the face plate above the bulb and means on the shade to actuate the on-off switch upon rotational movement of the shade.

7. The integral night light assembly of claim 6 wherein the means on the shade to actuate the on-off switch comprise a cross-bar on the shade.

* * * * *